US005906080A

United States Patent [19]

diGirolamo et al.

[11] Patent Number: 5,906,080

[45] Date of Patent: May 25, 1999

[54] BRACKET FOR INTERCONNECTING A BUILDING STUD TO PRIMARY STRUCTURAL COMPONENTS

[76] Inventors: Edward R. diGirolamo, 8617 Davishire Dr.; Richard Mountcastle, 12121 Castle Ridge Rd., both of Raleigh, N.C. 27615

[21] Appl. No.: 08/857,751

[22] Filed: May 15, 1997

[51] Int. Cl.[6] ..... E04H 14/00

[52] U.S. Cl. ..... 52/243.1; 52/656.1; 52/656.9; 411/546

[58] Field of Search ..... 52/235, 238.1, 52/239, 243, 243.1, 731.7, 730.6, 733.1, 656.9, 241, 665, 712, 714, 126.3; 248/295.11, 300; 411/546, 542, 368, 84, 85, 155, 156, 531

[56] References Cited

U.S. PATENT DOCUMENTS

| | | | |
|---|---|---|---|
| 3,831,333 | 8/1974 | Nelsson et al. | 52/241 |
| 3,940,900 | 3/1976 | Russo | 52/238.1 X |
| 5,127,760 | 7/1992 | Brady | 52/241 X |
| 5,209,621 | 5/1993 | Burbidge | 411/546.2 |
| 5,313,752 | 5/1994 | Hatzinikolas | 52/243 |

OTHER PUBLICATIONS

Sales brochure from The Priceless Company.

*Primary Examiner*—Creighton Smith
*Attorney, Agent, or Firm*—Olive & Olive, P.A.

[57] ABSTRACT

Apparatus is provided for assembling a curtain wall, which is anchored at one end to a floor and at an opposite end to a primary structure in a sliding relation thereto in order to allow relative vertical flexibility in case of severe vertical deflection due to loading. This sliding relation permits the building sections to move under wind, live load, dead load or seismic forces with a minimum of damage transferred to the curtain wall. The apparatus is a bracket with a first plate for mounting to the primary structure and a second plate for mounting in sliding relation to the wall studs. The second plate is formed with slots which are vertically oriented, and a fastener with a spacer are fastened through each slot.

9 Claims, 4 Drawing Sheets

BRACKET FOR INTERCONNECTING A BUILDING STUD TO PRIMARY STRUCTURAL COMPONENTS

BACKGROUND OF THE INVENTION

1. Field of the Invention

This invention relates to steel stud building systems, and, more particularly to apparatus for connecting vertical steel wall studs to a building structure in a manner to permit relative vertical movement but prevent relative horizontal movement therebetween.

2. Description of the Related Art

Many industrial and commercial buildings and an increasing number of residential buildings are being constructed with steel stud wall systems for the various benefits obtained, such as reduced environmental concerns, fire safety and freedom from warpage, insects, rust and rot.

In the construction of buildings which may be subject to deflection due to wind or seismic forces, it is preferable to allow a degree of freedom of movement to reduce stress and fracture of connected parts. Ceilings must rest directly on a structural frame or on load-bearing walls. Curtain walls, meaning walls such as partition walls which are not intended to support vertical loads, are best designed to not support vertical loads due to deflection of the primary structure of the building. Deflection is due to changes in the live loads. The term "primary structure" as used herein is meant to denote main supporting components to which secondary members are attached.

In addition to the occurrence of wind induced or seismic stress loading of a building structure, building component deflection is caused by changes in live or dead loading of the floor below or the ceiling above the curtain wall. However, typical prior construction systems have been designed according to the principal that all parts of a building must necessarily be connected in a rigid and permanent fashion. When such a building structure is stressed, curtain walls tend to be damaged and the degree of damage sustained by other building parts is also increased.

It is therefore an object of this invention to provide an apparatus for connecting a curtain wall to the primary structure so as to allow relative vertical movement therebetween while restricting relative horizontal movement.

It is an additional object of this invention to provide an apparatus for connecting a curtain wall which is relatively economical to produce and install.

Other objects and advantages will be more fully apparent from the following disclosure and appended claims.

SUMMARY OF THE INVENTION

The present invention comprises a stabilizing bracket presented in three embodiments for connecting the upper end of each stud in a curtain wall to a primary structure above so as to provide for relative vertical movement without permitting a significant amount of horizontal movement therebetween. The bracket provided is formed by bending a metal panel into two intersecting plates, one formed with or without one or more holes and the other with slots. The bracket is assembled securely to the primary structure above while being vertically slidingly connected to each stud's upper end. Components are provided to securely connect the bracket to the stud, while not restricting sliding movement between the two parts.

DETAILED DESCRIPTION OF THE INVENTION AND PREFERRED EMBODIMENTS THEREOF

Figure 1:
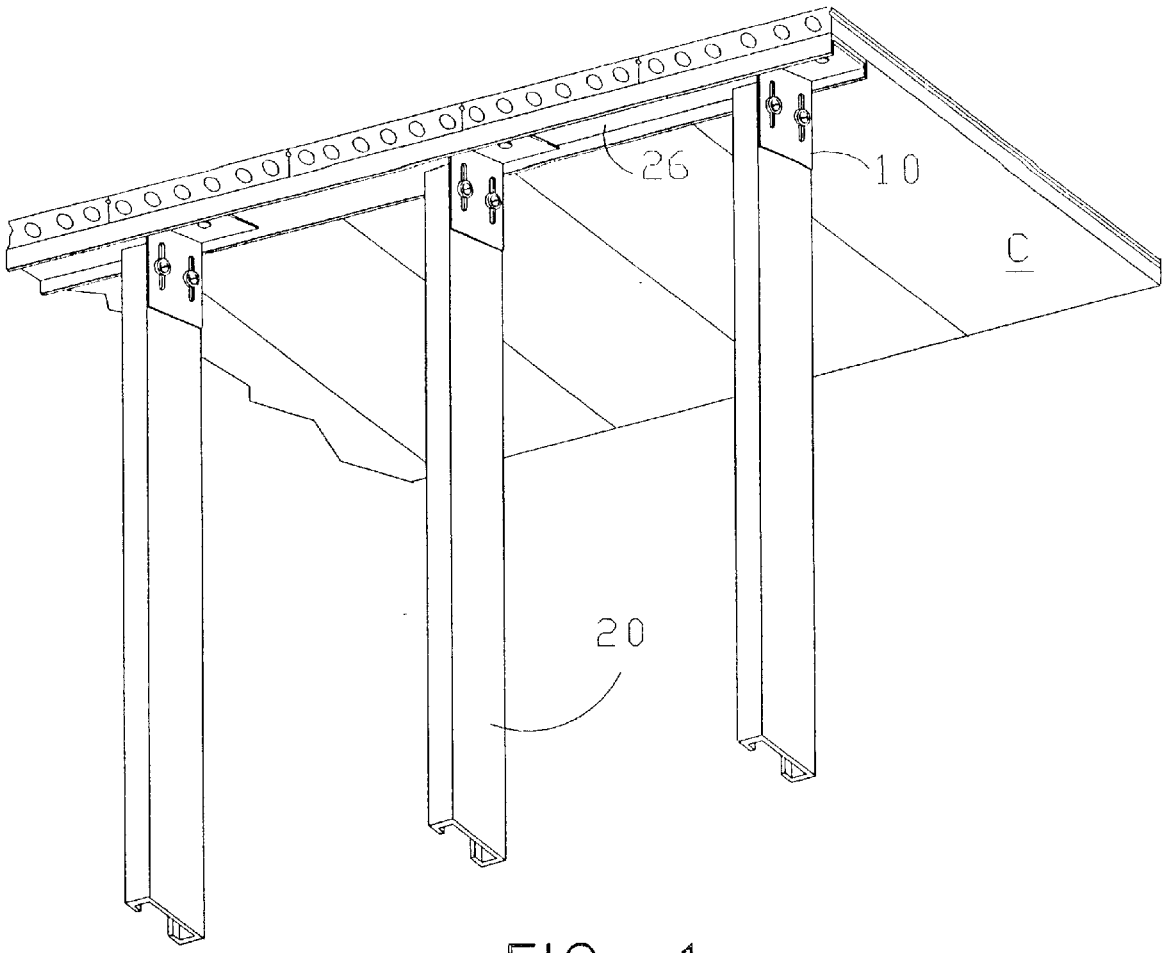
FIG. 1 is a perspective view illustrating steel studs of a curtain wall connected by a series of the invention brackets to precast hollow core concrete panels.

According to the objects outlined above, the steel stud stabilizing bracket 10 of the present invention is shown in FIG. 1 in an assembled building structure as it is connecting each of a series of studs 20 of a curtain wall (not shown) to primary structure C installed thereabove. An enlarged segment of FIG. 1 is shown in FIG. 3. Primary structure C in the example used for illustration is made of a plurality of reinforced, hollow-core, cast stud-plank members which are connected to each other at their mutual contact edges and supported by a building frame (not shown). For reasons of flexibility in case of vertical movement cycles, the floor below a curtain wall and the ceiling above a curtain wall each need to be able to move independently in a vertical direction. For this reason, bracket 10 of the invention is provided with the ability to allow relative vertical movement of assembled building components when bracket 10 is assembled to track 26. Bracket 10 is shown alone in greater detail in FIG. 2 and as assembled in FIG. 3. Studs 20 illustrate one form of structural support for a curtain wall, but are not to be construed as limiting the scope of the invention.

Figure 2:
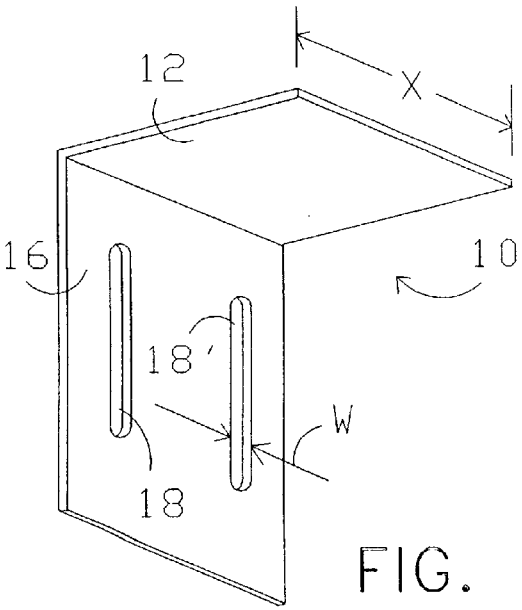
FIG. 2 is a perspective view of the first embodiment of the bracket of the present invention.
Figure 2A:
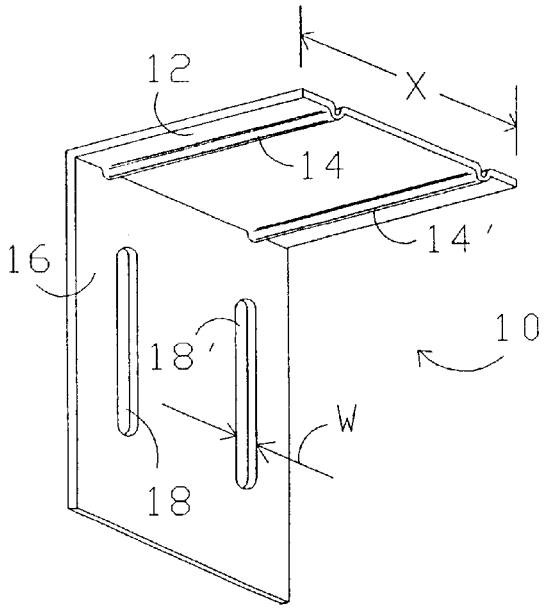
FIG. 2A shows a modified version of the bracket of FIG. 2.
Figure 3:
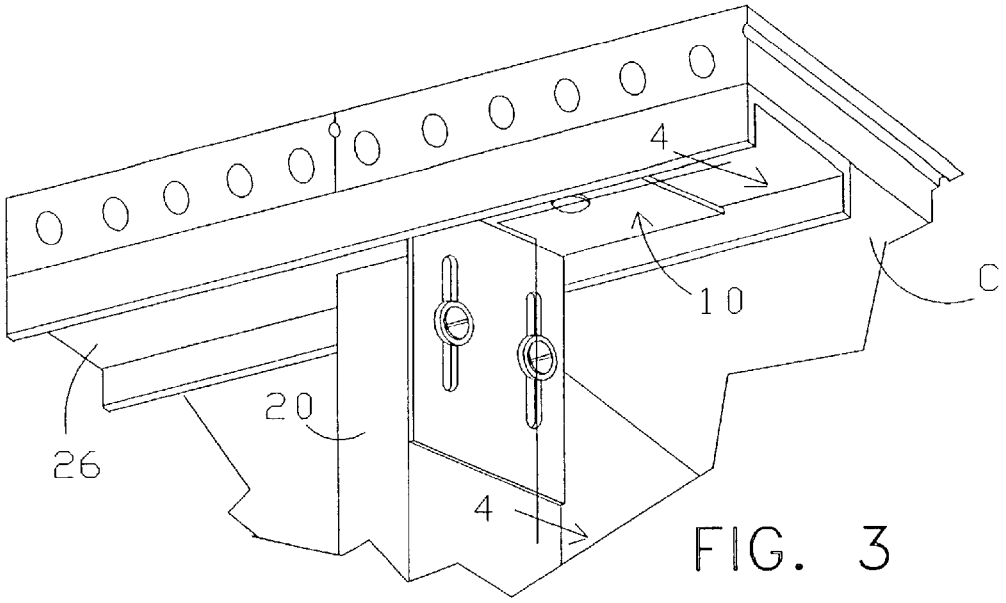
FIG. 3 is an enlarged perspective view of a portion of the curtain wall of FIG. 1.

Referring now to FIG. 2, bracket 10 is formed from a stiff, thin material, such as, for example galvanized sheet steel having a thickness of about 0.056 inch (commonly known as 16 gauge). Bracket 10 has a pair of mutually perpendicular planar portions, designated top plate 12 and side plate 16. According to the preferred embodiment of the invention, top plate 12 is formed without a hole since the preferred mode of mounting to primary structure C involves use of an explosive fastener nail gun, such as the type device known in the trade under the name "Hilti" or the name "Ramset". Optionally, a hole may be formed through top plate 12. Side plate 16 is formed with a pair of substantially parallel, elongate slots 18, and 18' the axes of which are oriented perpendicular to the plane of top plate 12. In an alternate embodiment (not shown) top plate 12 is formed with two holes and side plate 16 is formed with only one slot. Width X of bracket 10 is preferably of a dimension which permits plate 12 to fit slidingly into track 26 and prevent relative rotation therebetween. A modified version of bracket 10 is shown in FIG. 2A, where a pair of stiffening ridges 14 are formed on top plate 12 in perpendicular relation to side plate 16. Stiffening ridges 14, and 14' each comprise a substantially "U" shaped channel in top plate 2, forming perpendicular members to increase the bending stiffness thereof.

Figure 4:
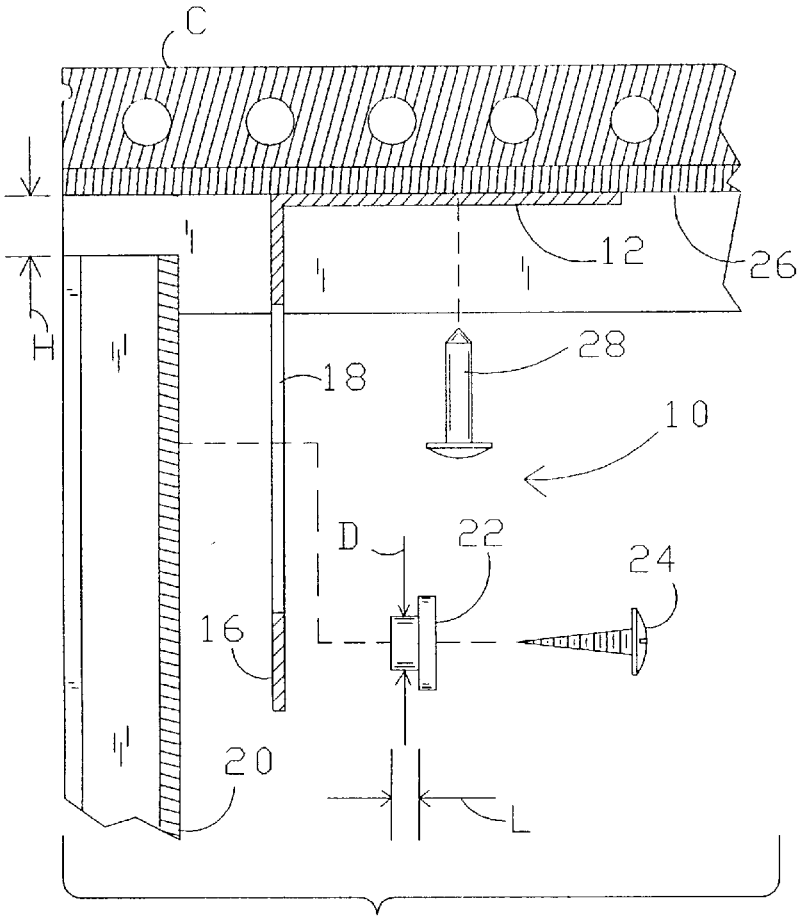
FIG. 4 is a cross sectional and exploded view taken along line 4—4 of FIG. 3.
Figure 5:
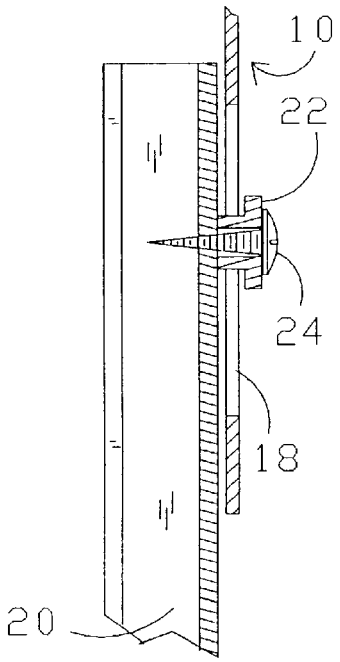
FIG. 5 fragmentary cross sectional view of the bracket of FIG. 3 assembled to a steel stud.

Further details of the first embodiment bracket of the invention are shown in FIGS. 4 and 5. FIG. 4 illustrates bracket 10 in cross section as it is being positioned for permanent installation to a stud 20 and primary structure C. In assembled configuration, bracket 10 is placed in contact with the inner surface of the inverted U-shaped track 26 and is positioned to be moved into contact with stud 20. Fastener 28, e.g., an explosive fastener, is driven through top plate 12 and the horizontal planar web of track 26, and into primary structure C. In the first preferred embodiment, a spacer 22, having a shank diameter D and a shank length L, is used to maintain sliding space between bracket 10 and stud 20 so as to permit relative vertical movement between the floor and the ceiling connected thereby. With side plate 16 of bracket 10 substantially in contact with stud 20, a fastener 24, such as a sheet metal screw, is assembled through slot 18. A space, represented by height H, is maintained between the upper end of stud 20 and primary structure C, with fastener 24 inserted substantially in the center of the length of slot 18. Length L of spacer 22 is designed to be incrementally longer than the thickness of bracket 10, for example, 0.066 inch. A fastener formed with an integral shank, such as a shoulder screw or a stepped rivet, generally termed a spaced fastener, would serve similarly. Diameter D of the shank of spacer 22 is somewhat smaller than the width W of slot 18 (see FIG. 1) to allow freedom of relative vertical movement. Spacer 22 may be formed of either metal or a plastics resin, at the discretion of the designer. When fastener 24 and spacer 22 are assembled through slot 18, as shown in FIG. 5, the length L of the shank of spacer 22 prevents bracket 10 from binding tightly against stud 20, and permits relative sliding movement therebetween. Optionally, a lubricant may be used to reduce friction between moving parts.

Figure 6:
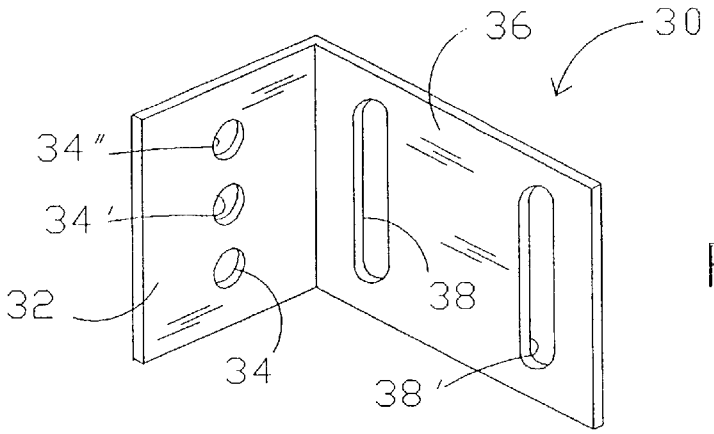
FIG. 6 is a perspective view of a second embodiment of the bracket of the present invention.
Figure 7:
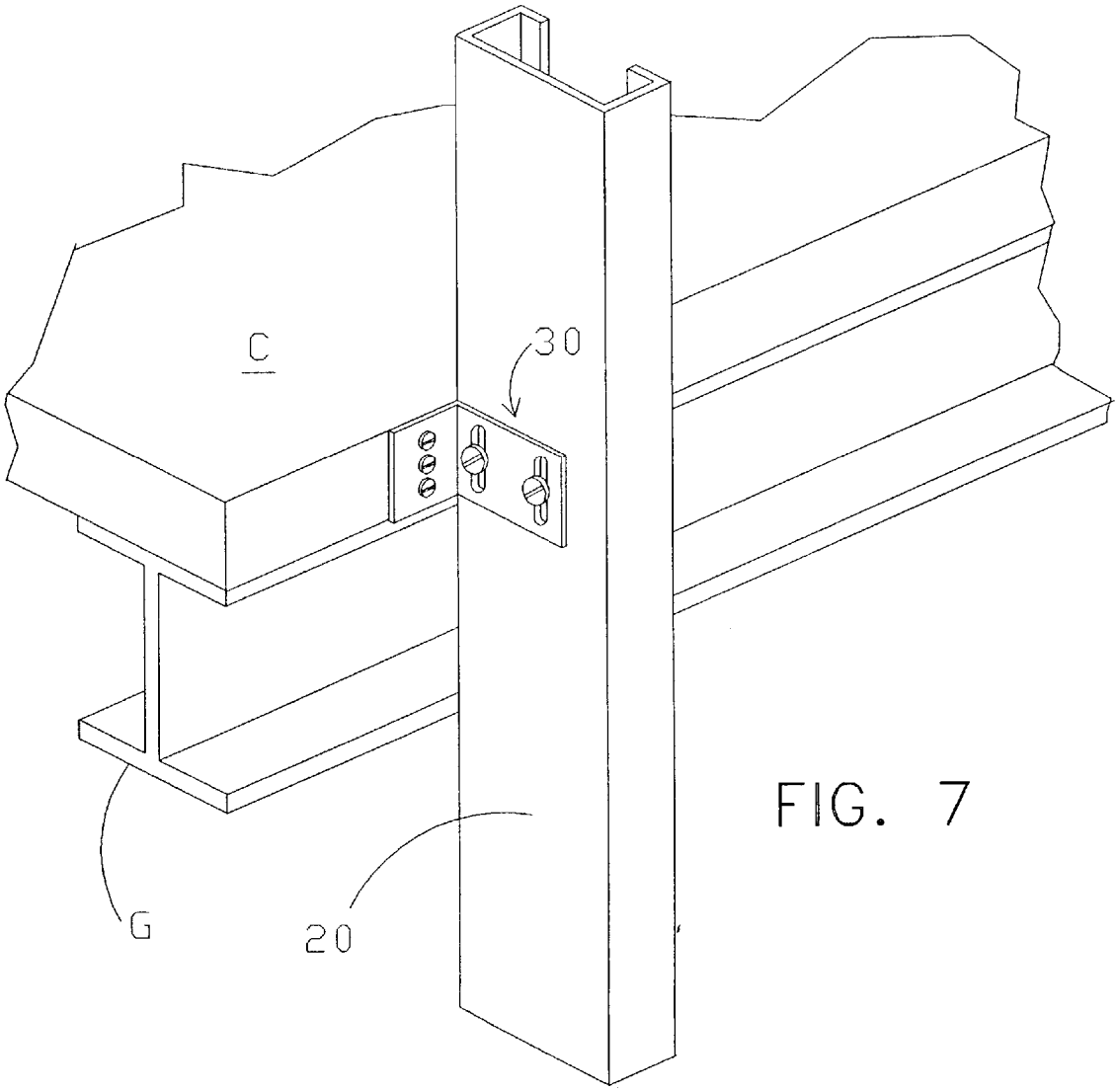
FIG. 7 is a perspective view of the bracket of FIG. 6 installed between a wall stud and a ceiling member so as to permit relative vertical movement therebetween.

A second embodiment of the invention is illustrated in FIG. 6 and FIG. 7 to enable laterally adjacent stud and ceiling components to be connected with relative vertical freedom of movement. Lateral bracket 30 is formed in similar fashion to the first bracket 10 by bending of a sheet of thin, stiff material to form a first side plate 32 and a second side plate 36. The difference, as portrayed in the drawings, is that three holes 34, 34' and 34" are provided in first side plate 32 and the axes of slots 38 and 38' in second side plate 36 are parallel to the bend line between the plates. In this fashion, lateral bracket 30 is prevented from rotating under stress. Similar fasteners with similar spacers are utilized to slidingly secure bracket 10 to primary structure C and stud 20 as described above.

The invention provides yet a third embodiment which is useful in a construction situation where a curtain wall of steel stud construction is positioned adjacent a structural girder. The third embodiment of the invention adapted to the condition described is shown in FIG. 8 and in assembly in FIG. 9.

Figure 8:
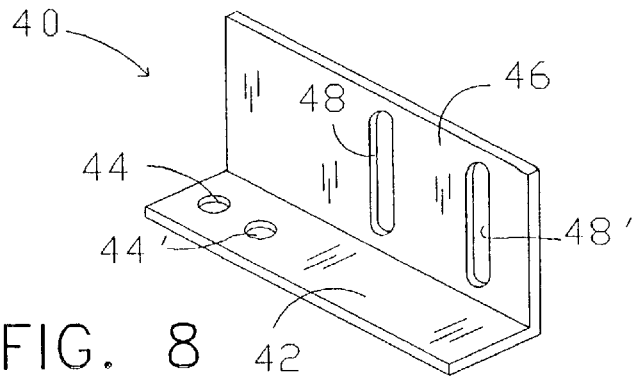
FIG. 8 is a perspective view of a third embodiment of the bracket of the invention.
Figure 9:
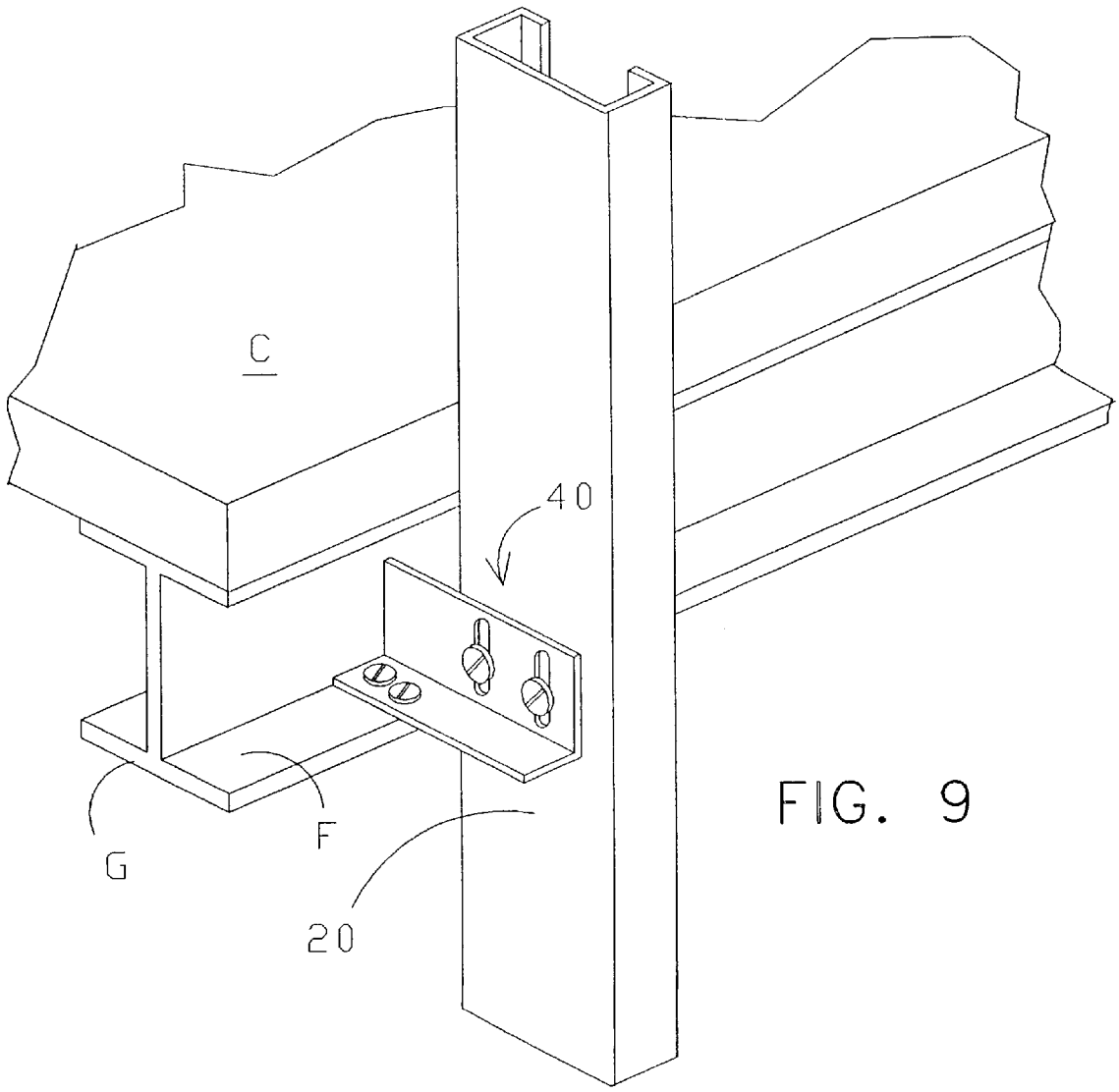
FIG. 9 is a perspective view of the bracket of FIG. 8 installed between a steel girder and an adjacent wall stud so as to permit relative vertical movement therebetween.

FIG. 8 shows bracket 40 which is similar to the bracket of the first embodiment and is also formed of sheet metal. Bracket 40 is adapted for a generally offset connection between a building structural frame and a curtain wall stud such as is encountered where a curtain wall is constructed over more than one building level. Bracket 40 has a first plate 42 which is formed at a substantially right angle connection to second plate 46. First plate 42 has a pair of holes 44 and 44' through essentially one end thereof. Second plate 46 has a pair of slots 48, and 48' formed through the end opposite to that wherein holes 44 are formed. In a mounted condition, a pair of fasteners, either screws or explosive driven nails, assembly bracket 40 to a flange F of girder G (see FIG. 9). Then a pair of screw fasteners with spacers attached as described above with regard to the first embodiment (FIG. 4) anchor the opposite end of bracket 40 in vertically sliding relation to stud 20.

As described above, all three embodiments of the invention disclosed accomplish the same objectives in substantially similar fashion. All the embodiments of the invention bracket comprise two plates, one of which is fastened fixedly to a first building component, and the second of which is fastened to a second building component in a manner to permit relative vertical movement therebetween.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. Apparatus for connecting between a pair of mutually perpendicular building members in a manner to allow relative vertical movement therebetween, said apparatus comprising:

(a) a bracket having:

(i) a first plate having a first linear edge; and (ii) a second plate having a selected thickness and a second linear edge and being integrally connected to said first plate with said first linear edge and said second linear edge coinciding, said second plate formed with at least one linear slot therethrough, said slot having a selected width;

(b) first fastening means passing through said first plate for fixedly assembling said bracket to a supporting building component;

(c) a spacer having an axial bore, a shank with a length greater than the selected thickness of said second plate and an outside diameter less than the selected width of said slot and assembled with said shank passing slidingly through said slot; and (d) second fastening means passing through said axial bore of said spacer to slidingly assemble said bracket to a stud.

2. The apparatus described in claim 1 wherein said second plate is formed with two slots.

3. The apparatus described in claim 1 wherein said second fastening means comprises a fastener with a spacer, said spacer having a shank with a length greater than the thickness of said second plate and a diameter less than the width of said slot.

4. The apparatus described in claim 1 wherein said at least one linear slot is oriented substantially perpendicular to said first and second linear edges.

5. The apparatus described in claim 1 wherein said at least one linear slot is oriented substantially parallel to said first and second linear edges.

6. The apparatus described in claim 1, further comprising a pair of stiffening ridges formed in said first plate in an orientation substantially perpendicular to said linear edge.

7. The apparatus described in claim 1 wherein one or more holes are formed at a first end of said bracket and said one or more slots are formed at a second end of said bracket which is laterally offset from said first end in a direction substantially parallel to said linear edges.

8. The apparatus described in claim 1 wherein said first plate is formed of a width adapted to fit slidingly into a track mounted to said supporting building component above said curtain wall.

9. A connector for connecting each of a plurality of framing studs in a building curtain wall to a supporting building component in a manner to allow relative vertical movement therebetween, said connector comprising:

(a) a bracket having:

(i) a substantially planar first plate having a first linear edge; and (ii) a substantially planar second plate having a selected thickness and a second linear edge and being integrally connected to said first plate with said first linear edge and said second linear edge coinciding, said second plate formed with at least one linear slot therethrough, said slot having a selected width;

(b) first fastening means passing through said first plate and fixedly assembling said bracket to said supporting building component; and (c) second fastening means having a shoulder portion with a first selected diameter smaller than said selected width of said slot and a length greater than said selected thickness, a head portion formed on a first end of said shoulder portion and having a second selected diameter larger than said selected width of said slot and a shaft portion formed axially on a second end of said shoulder portion and having a third selected diameter smaller than said first selected diameter for fixedly engaging said stud.

* * * * *

UNITED STATES PATENT AND TRADEMARK OFFICE

CERTIFICATE OF CORRECTION

PATENT NO. : 5,906,080
DATED : May 25, 1999
INVENTOR(S) : Edward R. diGirolamo and Richard Mountcastle It is certified that error appears in the above-identified patent and that said Letters Patent is hereby corrected as shown below:

Column 2, line 10, after "Fig. 5", insert --is a--.

Column 3, line 3, "top plate 2" should read --top plate 12--.

Column 3, line 50, "bracket 10" should read --bracket 30--.

Column 3, line 58, after "to the bracket", insert --10--.

Column 4, line 3, "assembly" should read --assemble--.

Signed and Sealed this

Fifth Day of October, 1999

*Attest:*

Q. TODD DICKINSON

*Attesting Officer*

*Acting Commissioner of Patents and Trademarks*